US006385813B1

(12) United States Patent
Wuchevich

(10) Patent No.: US 6,385,813 B1
(45) Date of Patent: May 14, 2002

(54) FLEXIBLE TACK STRIP

(75) Inventor: Marlene Wuchevich, 6411 SW. 15$^{th}$Ct., Pompano Beach, FL (US) 33068

(73) Assignee: Marlene Wuchevich, Pompano Beach, FL (US)

( * ) Notice: Subject to any disclaimer, the term of this patent is extended or adjusted under 35 U.S.C. 154(b) by 0 days.

(21) Appl. No.: 09/055,390

(22) Filed: Apr. 6, 1998

(51) Int. Cl.$^{7}$ ..... A47G 27/04
(52) U.S. Cl. ..... 16/16
(58) Field of Search ..... 16/16, 8, 4, 6, 16/7, 17.1

(56) References Cited

U.S. PATENT DOCUMENTS 3,008,173 A * 11/1961 Goss et al. ..... 16/16
3,673,633 A * 7/1972 Frebraro ..... 16/16
3,828,391 A * 8/1974 Sutton et al. ..... 16/16
3,858,269 A * 1/1975 Sutton et al. ..... 16/16
4,970,754 A * 11/1990 Anderson et al. ..... 16/16
5,500,980 A * 3/1996 Morrow et al. ..... 16/16

* cited by examiner

*Primary Examiner*—Chuck Y. Mah

(57) ABSTRACT

A flexible tack strip, which is a series of plastic pads connected by a flexible spline provides a totally unique system for the attachment of one carpet edge to another. The captive tacks function in much the same manner as a conventional tack strip, however, the conventional tack strip cannot bend around a curve. The flexible tack strip can follow a curvature with ease. The flexible tack strip can be secured to the floor or any other surface, including in wet areas with a variety of fastening devices and compositions.

14 Claims, 1 Drawing Sheet

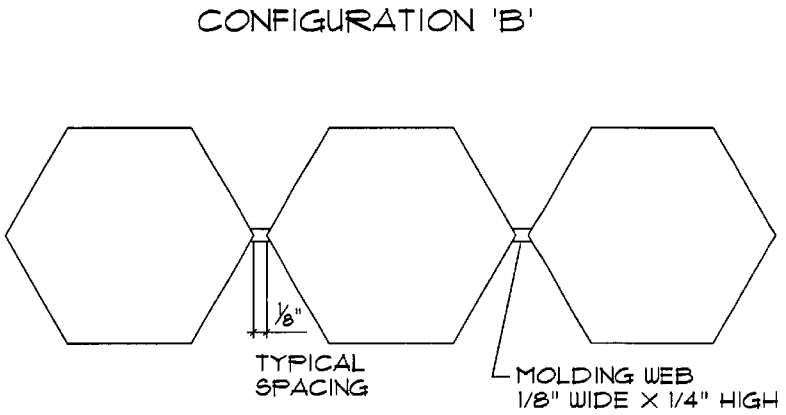
FIG. 2
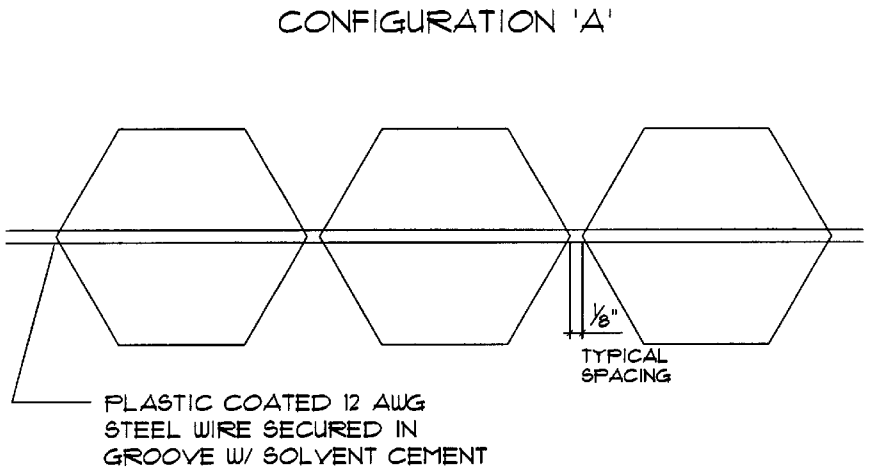
FIG. 1
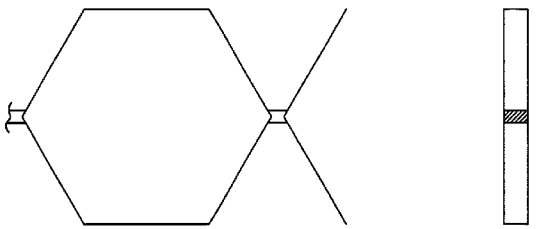
FIG. 5
FIG. 6
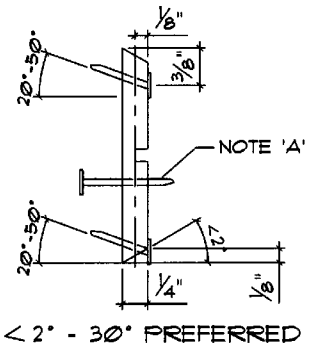
FIG. 4
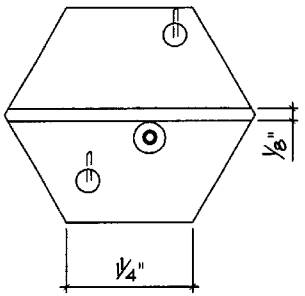
FIG. 3

FLEXIBLE TACK STRIP

FIELD OF THE INVENTION

A device that will facilitate and effectively permit carpeting/rugs of varying compositions Weights and textures to follow free form contours and be affixed to the floor, wall, ceiling, or any other surface without having to resort to the traditional breaking and cutting of wooden or metal tack strips. It is designed to be used with any carpet that can be affixed or held in place with conventional tack strips. This device, typically made of a plastic material or a combination of plastic and metal and consists of hexagonal retainer pads, (other shapes can be utilized, hexagonal is the shape of choice) he compound for the plastic is non critical, the only requirement being that it be flexible and non brittle. The device has tack nails imbedded onto each disk to hold the carpet taut after it has been stretched over the tack nails and also has provision for optional captive nails for securing the device to a surface. The securing nails may be steel nails for going into concrete or regular nails for going into wood or other material.

REFERENCES CITED

U.S. PATENT DOCUMENTS

| | | |
|---|---|---|
| U.S. PAT. NO. 4,581,269 | 4/8/86 | MINIGRIP, INC. |
| U.S. PAT. NO. 5,014,390 | 5/14/91 | FACAMl |
| U.S. PAT. NO. 4,998,319 | 3/12/91 | individual |
| U.S. PAT. NO. 4,875,250 | 10/24/89 | AUTOMOBILES PEUGEOT |
| U.S. PAT. NO. 4,843,676 | 7/4/89 | Individual |
| U.S. PAT. NO. 4,837,889 | 6/13/89 | Individual |
| U.S. PAT. NO. 4,759,096 | 7/26/88 | Individual |
| U.S. PAT. NO. 4,653,138 | 3/31/87 | Individual |
| U.S. PAT. NO. 4,561,146 | 12/31/85 | Individual |
| U.S. PAT. NO. 4,187,656 | 2/12/80 | individual |
| U.S. PAT. NO. 4,009,505 | 3/1/77 | YOSHIDA KOGYO KAISHA |
| U.S. PAT. NO. 4,086,679 | 5/2/78 | U.S.M. CORPORATION |

DESCRIPTION OF THE RELEVANT PRIOR ART

Typically, when a person needed to cut a carpet and have the edge follow a free form design, the currently available wooden or metal tack strips for securing the carpet taut and affixed to the base, such as a floor cannot be bent to conform to a curvature of a free form design. The current practice consists of the person use the time consuming process of cutting up or breaking up the wooden or metal tack strips into small pieces and securing them to the base, such as a floor. The small pieces would then be rough fit to the desired contour of the free form design and each individual strip secured to the base. The carpeting would then be affixed to the small individual tack strips. This method is extremely time consuming and is a frustrating process.

There has been a long standing need for a simple, yet effective flexible tack strip that will conform to the curvatures of free form designs that are prevalent in homes, commercial buildings and yachts.

The above mentioned U.S. Patents, were granted to the various applicants and do not contain any device which would permit a person to depart from the traditional time consuming method of breaking and cutting wooden or metal tack strips into small pieces so as to conform to the curvature of a free form design.

A U.S. Patent was granted to an Applicant, U.S. Pat. No. 4,581,2699 while having flexibility in the same plane as the surface of the carpet, does not posses the flexibility to follow the sculptured curvatures that are prevalent in free form designs. Additionally this item does not provide a built in means for affixing to a surface. This item is primarily meant, per the patent application for exceptionally large areas where artificial turf is employed. It also requires a mesh backing scrim for bringing two edges together.

U.S. Patent was granted to an Applicant, U.S. Pat. No. 5,014,390 which is essentially an item used to attach a carpet or mat to a base supported by sheet metal. This device uses an item with a pig tail screw and therefore does not approach the concept of the flexible tack strip.

A U.S. Patent was granted to an Applicant, U.S. Pat. No. 4,998,319, which essentially fits under a saddle or similar device and secured to same for the purpose of securing the carpet in place under the item. This item does not function like the Flexible Tack Strip A U.S. Patent was granted to an Applicant, U.S. Pat. No. 4,875,250, is a clip for use in automobiles and clips over a metal channel and therefore does not compare to the Flexible Tack Strip.

A U.S. Patent was granted to an Applicant, U.S. Pat. No. 4,843,676 and consists of a clip which holds a tack strip to a surface. However the item is not a tack strip and therefore cannot be considered as comparable to the Flexible Tack Strip.

A U.S. Patent was granted to an Applicant, U.S. Pat. No. 4,837,889, and consists of a rigid piece of angle for floor to wall installation. The rigid construction defeats the concept of flexibility and therefore does not compete with the Flexible Tack Strip.

A U.S. Patent was granted to an Applicant, U.S. Pat. No. 4,759,096, and consists of a strip to secure a carpet against a vertical surface. This item does not have the flexibility to conform to curvatures, therefore does not compete with the Flexible Tack Strip.

A U.S. Patent was granted to an Applicant, U.S. Pat. No. 4,653,138, and consists of a channel to wood item in order to secure the carpet. This item lacks the flexibility to follow a curvature like the Flexible Tack Strip.

A U.S. Patent was granted to an Applicant, U.S. Pat. No. 4,561,146, which is essentially a flat saddle like item which does not have the flexibility of the Flexible Tack Strip, nor does it perform the same function.

A U.S. Patent was granted to an Applicant, U.S. Pat. No. 4,187,656, is essentially a rigid metal border edge which is place under the carpet and a return clamped over the top. This item cannot follow curvatures like the Flexible Tack Strip and therefore does not compare.

A U.S. Patent was granted to an Applicant, U.S. Pat. No. 4,009,505, is a sheet metal item with projections and clamps on the edge of the carpet with a sliding clasp. The configuration and design of this item prohibits it from functioning in like manner as the Flexible Tack Strip.

A U.S. Patent was granted to an Applicant, U.S. Pat. No. 4,086,679, consists of a ribbed strip which uses the ribs to hold the carpet in place, however it lacks the flexibility to conform to free form curvatures like the Flexible Tack Strip, nor does it perform the same function. What is desirous to be had by the appropriate population at large, is the embodiment of all the attributes of this particular invention, the Flexible Tack Strip. Not only does it secure carpet to a base such as floors, walls and table tops, but it permits the user to follow the curvatures of free form designs without the tedious, time consuming and wasteful process of breaking wooden tack strips into small segments in order to approximate the desired curvature or cut metal strips into small segments in order to approximate the desired curvature. The Flexible Tack Strip accomplishes this without cumbersome breaking and splintering wood nor cutting metal. By the flexible spine, the Flexible Tack Strip can be formed to conform to the curvature of free form designs. With a simple cut to overall length, the appropriate curvature can be formed without the devices or components indigenous to the current state of the art. These functions or embodiments are highly beneficial to carpet and tile contractors and installation personnel as well as to the public at large.

SUMMARY OF THE INVENTION

Subject invention entitled "FLEXIBLE TACK STRIP. is a device that will facilitate and effectively secure carpeting or other like material to a given surface so that it does not separate or pull away from its mating edge, nor cause the carpeting or other material to buckle due to stretching. The subject item will conform to contours by grasping the Flexible tack Strip with ones hands and bend it with simple hand pressure to the desired shape. The flexible Tack Strip is then cut, if required, to the desired length. The Flexible Tack Strip is then secured to a subsurface such as a floor with the appropriate nails. The Carpet is then stretched up and over the protruding "tacks" and with appropriate downward pressure, the carpet is impaled on the "tacks".

BRIEF DESCRIPTION OF THE DRAWINGS

The following drawing is referenced throughout the detailed description:

FIG. 1 is a diagrammatical representation of the FLEXIBLE TACK STRIP.

FIG. 2 shows the preferred dimensions of the flexible tack strip according to the invention;

FIG. 3 shows the flexible tack strip with securing nails;

FIG. 4 is a cross-sectional view of FIG. 3;

FIG. 5 is another embodiment having the webs and pads formed by molding, and FIG. 6 is a cross-sectional view of FIG. 5.

DESCRIPTION OF THE PREFERRED EMBODIMENT

The ingenious approach to overcome the traditional obstacles in conforming a heretofore rigid tack strip to a curvature is totally unique and revolutionary in its approach and subsequent design. Of import to note, is the flexible web between the pads extending along a longitudinal axis or a centerline. This web allows the strip to be easily bent or shaped to the curvature of a design. The pads have protruding "tacks" on which to impale the carpet and thus hold it secure from shifting. The securing nail which holds the pad in place to the surface may or may not be included in the production unit. This option is user dependent as a user may specify steel nails for use on concrete, or standard wire nails for use on wood or plaster (board) or any other surface. A further ingenious benefit of the configuration is that the nails may be omitted entirely so that the pad may be secured by other means such as staples or adhesive, or any other suitable means as the user may employ. Of notable consideration is the means of which the Flexible Tack Strip can be structured. One such means, as shown, is that the pads are produced separately with a groove in the underneath section of the pad. A coated wire is embedded into the groove and may be secured in place with a suitable cement. The cementing in place, while desirable, is not the crucial aspect of the Flexible Tack Strip, and thus it is not a requirement that the wire be secured in place. Of alternate construction, is the incorporation of a molded in place web, that would be formed when the pads are formed and would be produced in a length as determined by production and user requirements.

The simplicity of this invention, with its flexibility and multiplicity of use, makes this invention exceptionally desirous to users. Its functionality and ease and economy of use makes this totally unique amongst all other tack strips. When a carpet or other similar material is cut or shaped in an irregular or curved edge configuration, the subject device is fastened to the surface or subsurface to which the carpet or other material will cover or rest upon. The device 1 can be bent 2 or shaped to any irregular or curved configuration and fixed to the surface, typically with 4 nails. However, screws, staples, adhesives or other fastening devices may be employed as well. The carpet or other similar material is then placed on top of the captivated holding nails or tacks 3. The carpet or other similar material is then pressed down on the captivated holding nails or tacks 3 so that the carpet or other similar material is impaled and thus secured in a taut state.

It is contemplated that other designs of the FLEXIBLE TACK STRIP, may be advantageously employed with other than the exact embodiments depicted herein. Furthermore, the above description has described the present invention with a specific design and configuration. It is to be understood that changes could be made to the configuration, and design which would still result in the functionality remaining essentially the same as what this invention is presented as having, and capable of accomplishing. Thus, while the present invention has been described with reference to certain depicted embodiments and exemplifications thereof, doubtless one of skill in the art, and having the benefit and/or aid of the teachings of the present invention, could design certain variations thereof. Without departing from the scope of the present invention. It is the claim appended hereto, and all reasonable equivalents thereof, rather than the exact depicted embodiments and exemplifications, which define the true scope of the invention.

What is claimed is:

1. A flexible tack strip comprising:

a plurality of generally planar pads adapted to be secured to a structure;

at least one carpet holder attached to each pad so that a carpet can be held captive by said carpet holder;

a groove formed in a bottom surface of each pad; and a flexible wire placed in the grooves to connect the pads together.

2. The flexible tack strip of claim 1 wherein the pads are regular polygons.

3. The flexible tack strip of claim 1 wherein the pads are hexagons.

4. The flexible tack strip of claim 1 wherein the pads are made of plastic.

5. A flexible tack strip comprising:

a plurality of generally planar pads joined together along a longitudinal axis which coincides with the centerline of the tack strip and is adapted to be secured to a structure;

at least one carpet holder attached to each pad so that carpet can be held captive by said carpet holder;

and an integral web joining the pads together with the web extending generally along the longitudinal axis.

6. The flexible tack strip of claim 5 wherein the pads are regular polygons.

7. The flexible tack strip of claim 5 wherein the pads are hexagons.

8. The flexible tack strip of claim 5 wherein the pads are made of plastic.

9. A flexible tack strip comprising a plurality of generally planar pads joined together along a longitudinal axis, each pad including means for fixing the pads to a surface and holder means for holding carpet captive to the pads, and an integral web joining the pads together with the web extending generally along the longitudinal axis which extends along the centerline of the tack strip.

10. The flexible tack strip of claim 9 wherein the pads are regular polygons.

11. The flexible tack strip of claim 9 wherein the pads are hexagons.

12. The flexible tack strip of claim 9 wherein the pads are made of plastic.

13. The flexible tack strip of claim 9 wherein the means for fixing the pads comprises nails.

14. The flexible tack strip of claim 9 wherein the holder means for holding carpet captive comprises tacks.

* * * * *